US005423637A

United States Patent [19]

Taki

[11] Patent Number: 5,423,637

[45] Date of Patent: Jun. 13, 1995

[54] LINER JOINING SYSTEM AND METHOD

[76] Inventor: Osamu Taki, P.O. Box 1297, Blemont, Calif. 94002

[21] Appl. No.: 105,887

[22] Filed: Aug. 11, 1993

[51] Int. Cl.[6] ..... E02D 29/00

[52] U.S. Cl. ..... 405/267; 405/129

[58] Field of Search ..... 405/38, 128, 129, 267, 405/274, 287

[56] References Cited

U.S. PATENT DOCUMENTS

| | | | |
|---|---|---|---|
| 3,224,205 | 12/1965 | Greiner et al. | 405/274 |
| 4,673,316 | 6/1987 | Nussbaumer et al. | 405/267 |
| 4,741,644 | 5/1988 | Cavalli et al. | 405/267 X |
| 5,066,353 | 11/1991 | Bourdo | 405/274 X |
| 5,076,726 | 12/1991 | Heath | 405/38 |

FOREIGN PATENT DOCUMENTS

| | | | |
|---|---|---|---|
| 556304 | 8/1932 | Germany | 405/274 |
| 100216 | 6/1982 | Japan | 405/267 |
| 208514 | 10/1985 | Japan | 405/274 |
| 126220 | 6/1986 | Japan | 405/267 |

*Primary Examiner*—Randolph A. Reese
*Assistant Examiner*—John A. Ricci
*Attorney, Agent, or Firm*—Greg T. Sueoka

[57] ABSTRACT

A cutoff wall liner joining method includes the steps of: (1) excavating a slurry trench; (2) positioning a first layer of liner material within the excavated trench; (3) positioning two pipes adjacent to the liner material in such a manner as to form a substantially S-shaped configuration of the liner material around the pipes; (4) back filling a portion of the trench adjacent a first one of the pipes; (5) removing the other, second one of the pipes; (6) excavating an additional portion of trench extending away from the back filled portion; (7) positioning a second layer of liner material within the newly excavated portion to form a overlapping portion of liner material; (8) positioning a pipe adjacent to the remaining pipe in the trench such that it overlays the overlapping portion of liner material, then positioning a third pipe in the excavated additional trench portion; (9) back filling a portion of the trench adjacent the third pipe; (10) removing the third pipe; (11) back filling the space left by the third pipe; and then (12) removing the two remaining pipes, back filling the space left by each pipe as it is removed.

19 Claims, 11 Drawing Sheets

LINER JOINING SYSTEM AND METHOD

BACKGROUND OF THE INVENTION

1. Field of the Invention

The present invention relates to methods for constructing cutoff walls having improved impermeability. In particular, the present invention relates to a method for joining liners installed in a slurry cutoff wall.

2. Description of Related Art

Cutoff walls typically are used to impede the lateral flow of ground water. Controlling the flow of ground water is essential to preventing contamination of the water supply. Cutoff walls are often used to isolate contaminated landfills and to prevent the ground water from being contaminated through contact with buried waste. Because of their low permeability, cutoff walls have also been used to seal darns, canal systems, and dikes for flood control purposes. Other applications for cutoff walls include: de-watering and protecting deep excavation projects, hydraulically isolating lagoons and holding ponds, and enclosing oil and chemical tank farms.

As illustrated in FIG. 1, slurry cutoff walls are generally constructed by excavating a narrow trench (2–4 feet slide) with a back hoe or similar device. During the excavation process, the trench is filled with slurry and maintained at a level near the top of the trench. The use of slurry, conventionally of bentonite and water, allows excavation without the need for other lateral support. The narrow trench is then back filled with excavated soil and selected impervious materials to create a cutoff wall. The selected materials are typically commercially available clays and cement. One advantage of the slurry technique is that it is relatively inexpensive to construct such a cutoff wall.

However, one problem with the cutoff walls of the prior art is their permeability. Slurry cutoff walls generally have a permeability that reaches at best $1\times10^{-6}$ to $5\times10^{-7}$ cm/sec. This becomes a problem when very low permeability is required such as when isolating hazardous wastes as shown in FIG. 2. When the waste site is near an aquifer or other ground water source, the permeability must be at least $1\times10^{-8}$ cm/sec. Very low permeability cutoff walls are also needed for flood control purposes to prevent seepage through dikes and to prevent influence on the areas surrounding the cutoff wall, as well as to prevent the collapse of dikes.

One system for improving the impermeability of the area surrounding such cutoff walls is described in U.S. Pat. No. 5,246,312. In that system, a liner manufactured from impermeable material is inserted into a slurry trench as the trench is excavated. That system discloses positioning a single sheet of liner material adjacent to the cutoff wall.

To further improve the impermeability of the cutoff walls, the liners are sometimes overlapped. However, if the overlapping portions of the liner are not joined, leakage and seepage between the overlapping portions of liner are detrimental to impermeability. Therefore, there continues to be a need for a method for efficiently joining overlapping liner material to improve cutoff wall impermeability.

SUMMARY OF THE INVENTION

The present invention overcomes the deficiencies of the prior art by providing a system and method for installing, overlapping, and connecting impermeable liner material to improve the impermeability of a slurry cutoff wall. The inventive method generally involves the steps of: (1) excavating a slurry trench; (2) positioning a first layer of liner material in the excavated trench; (3) positioning a first and second pipe on the opposite sides of the liner material to form a substantially S-shaped configuration of the liner material around the pipes; (4) back filling a portion of the trench adjacent the first pipe using a hardening filler material; (5) removing the second pipe; (6) excavating a portion of trench extending away from the back filled portion; (7) positioning a second layer of liner material in the newly excavated, additional trench portion, and then positioning a portion of the first layer of material parallel with a portion of the second layer of material to form an overlapping portion of liner material; (8) repositioning the second pipe adjacent to the first pipe in the trench such that the first and second pipes are on opposite sides of overlapping portions of liner material, (9) positioning a third pipe in the excavated additional trench portion; (10) back filling a portion of the trench adjacent the third pipe; (11) removing the third pipe from the trench; (12) back filling the space left by the third pipe with a hardening material; and (13) removing the two first and second pipes back filling the space left by each pipe with hardening material as it is removed.

In a preferred embodiment of the liner joining system of the present invention, the pipes are spacing pipes that have a central rigid pipe structure surrounded by a housing fillable with air or water via an attached or integral nozzle. Once the spacing pipes are properly positioned in the trench with respect to the trench walls and the liner material, a liquid or gaseous material, such as water, is introduced through the nozzle to expand the housing around the central pipe, and thus, secures the pipe in position between the walls of the trench. To remove the pipes, the material is released using the nozzle, thus, diminishing the volume enclosed by the housing to allow removal of the pipe.

In another embodiment of the method, an injection tube is installed between the first and second layer of liner material. Using the injection tube, a clearing material is first passed through the tube and between the first and second layer to clear away debris from between the layers of liner material. Next, an adhesive material is injected between the layers of liner to attach the layers of liner together. The injection tube may be either left in place, or removed after introduction of the adhesive material.

In other embodiments of the method, the liner material is positioned in a substantially U-shaped configuration about the first and second pipes. In such an embodiment, the liner material forms a substantially M-shape around the first and second pipes. The ends of the first and second layers of liner material proximate the central portion of the "M" can be joined by installing a joint pipe (a C shaped tube with a slit). The joint pipe receives an end of each liner material, and is then filled with a hardening material to secure the liner material ends in the pipe. The end result, after the trench is back filled, is a substantially M-shaped liner material in the filled trench.

Other features and advantages of the present invention will become apparent from the following description taken in conjunction with the accompanying drawings in which the like references designate the same elements and parts.

DETAILED DESCRIPTION OF THE PREFERRED EMBODIMENTS

Figure 1:
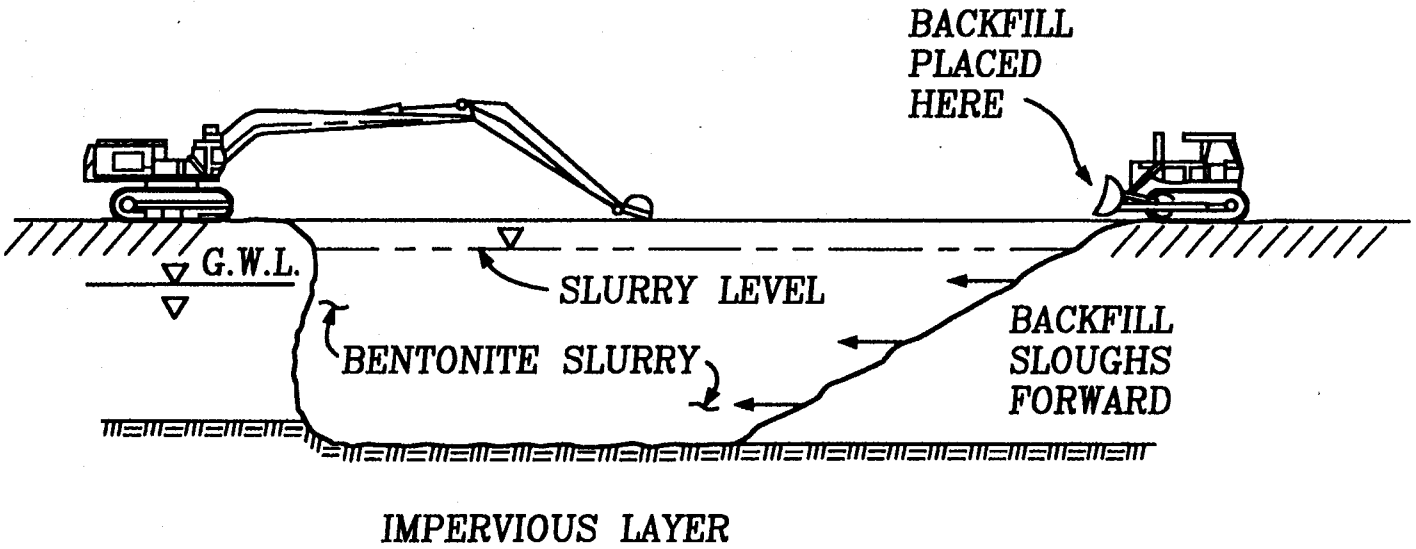
FIG. 1 (PRIOR ART)
FIG. 1 is a cross-sectional side view of the construction of a slurry cutoff wall as known in the art.
Figure 2:
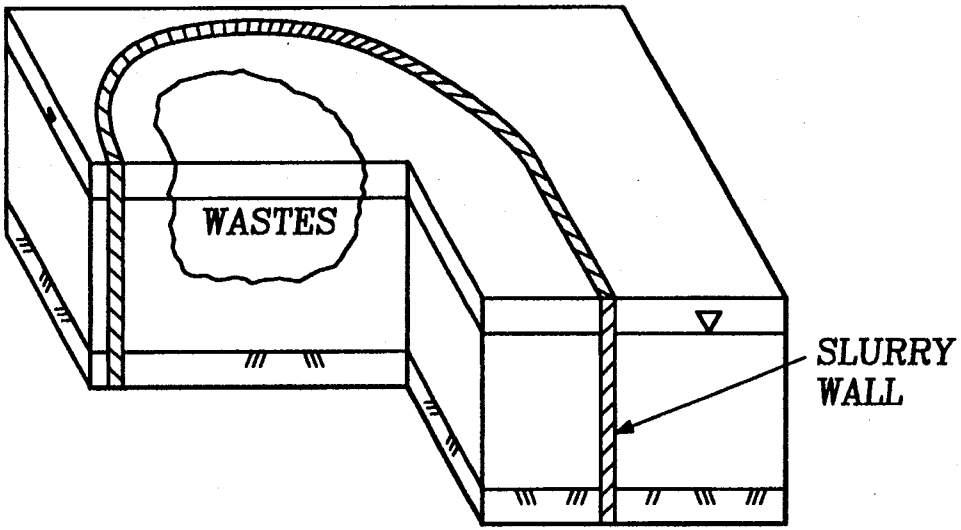
FIG. 2 (PRIOR ART)
FIG. 2 is a perspective view, partially in cross-section, showing a waste site isolated by a cutoff wall as known in the art.

The inventive method and system first involves excavation of a trench 22, substantially as shown in FIGS. 1 and 2. The trench 22 may be excavated using standard excavation methods, preferably a slurry trench excavation method. In using a slurry trench excavation method, the slurry preferably is maintained at a level close to ground level during the excavation step by pumping additional slurry into the trench 22 as required.

Figure 3:
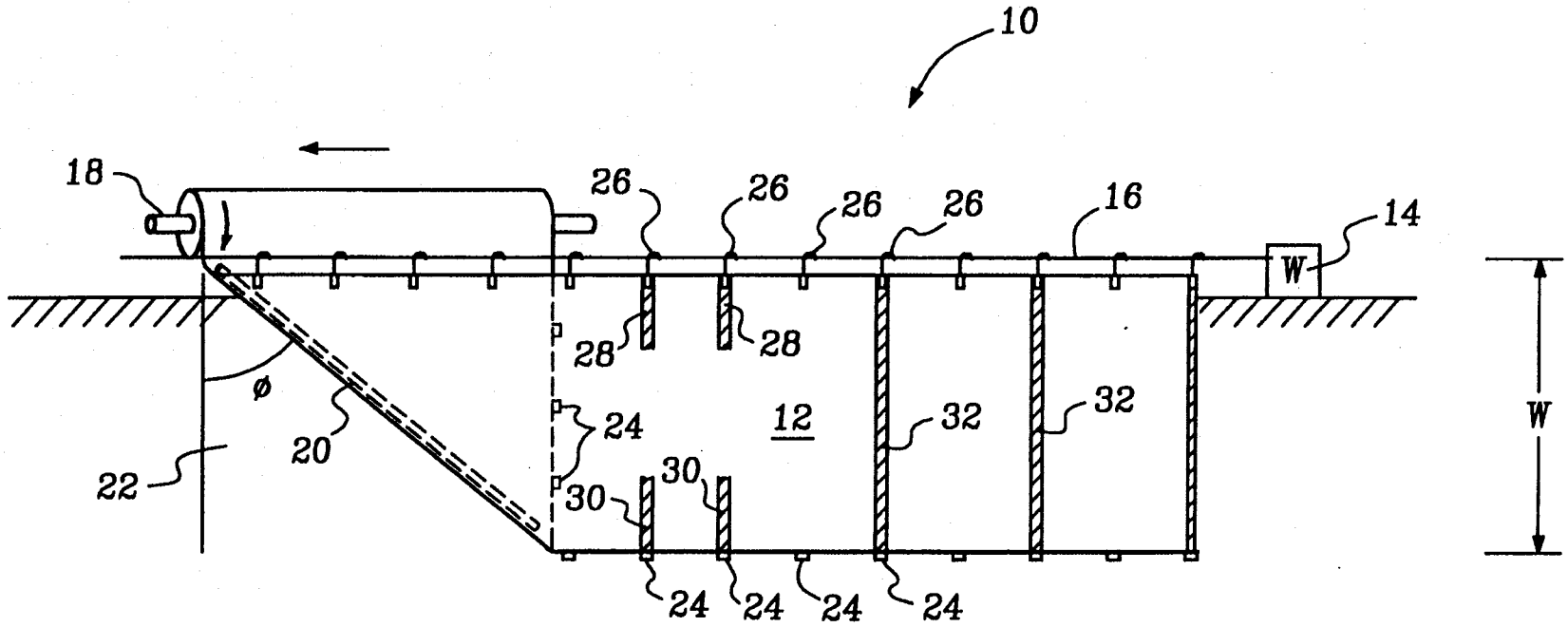
FIG. 3 is a simplified diagram of an exemplary lining system for inserting a liner in a slurry trench of the cutoff wall.
Figure 4A:
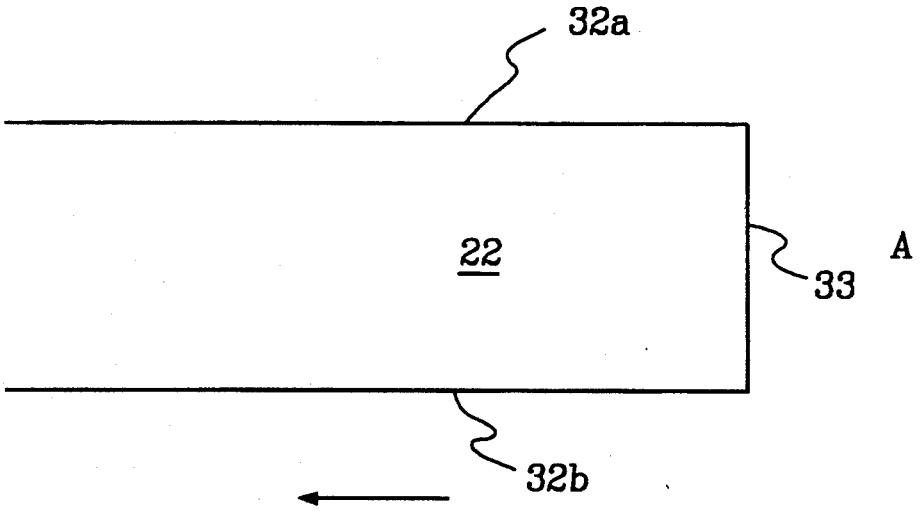
FIGS. 4A–4H are top plan views of a trench with a sheet of liner material inserted therein in accordance with the present invention.
Figure 4B:
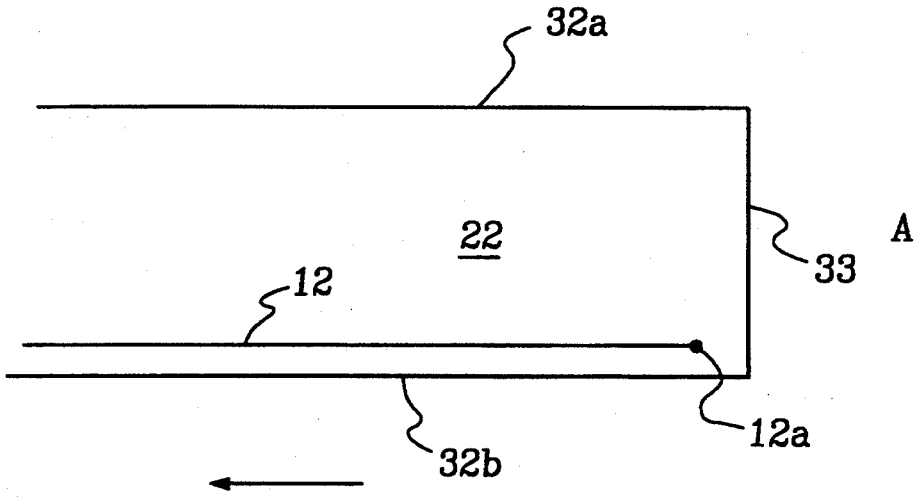

Liner material 12 is next positioned within the trench 22, as shown in FIG. 4B. One preferred system for delivering liner material 12 into a slurry trench is shown in FIG. 3. Briefly, that system includes a sheet of liner 12, an anchor 14, a support line 16, a positioning rod 18 and a guide 20. The liner 12 further includes weights 24 and fasteners 26. The liner 12 preferably is stored in a rolled form before insertion into the trench 22. The liner 12 preferably is unrolled at a rate that is about the same as the rate at which the roll of liner 12 is moved along the trench. The liner 12 is unrolled by forcing it downward in a vertical orientation with the aid of the weights 24 and gravity. As the rod 18 carries the rolled portion of the liner 12 along the trench 22, the liner 12 is unrolled and forced about the guide 20 to a vertical orientation in the trench 22. The anchor 14 is secured in the ground near the beginning of the trench 22. The support line 16 is attached to the anchor 14, and pulled tight parallel above the trench 22. The fasteners 26 are attached to the support line 16 to ensure that the liner 12 extends between the top and the bottom of the trench 22.

Although such a liner dispensing system 10 is herein disclosed as one embodiment for inserting a liner in a trench, other available methods and systems presently used by those skilled in the art may be used in practicing the present invention.

Figure 4C:
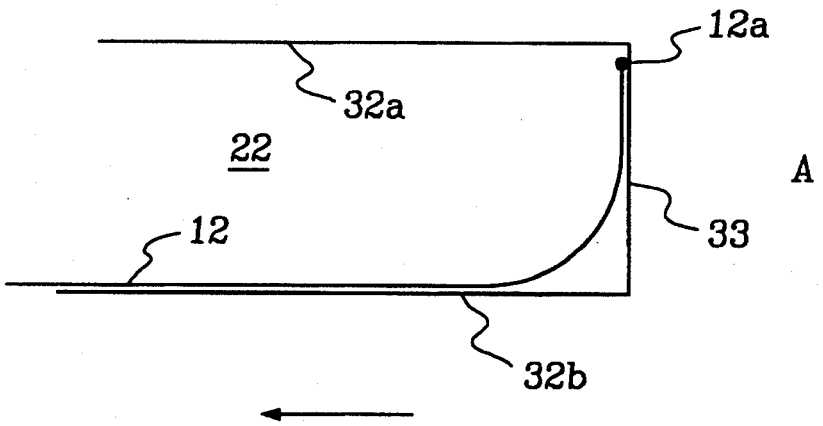
Figure 4D:
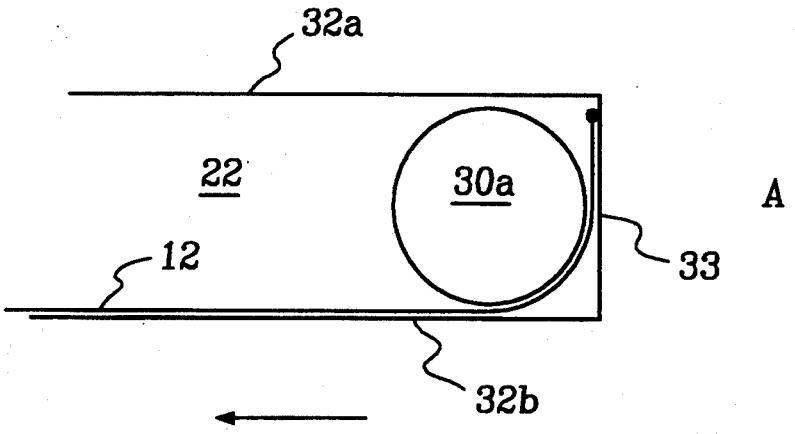
Figure 4E:
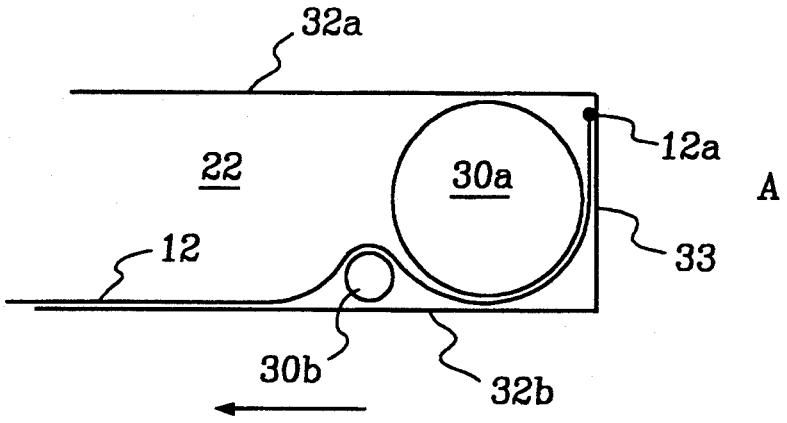
Figure 4F:
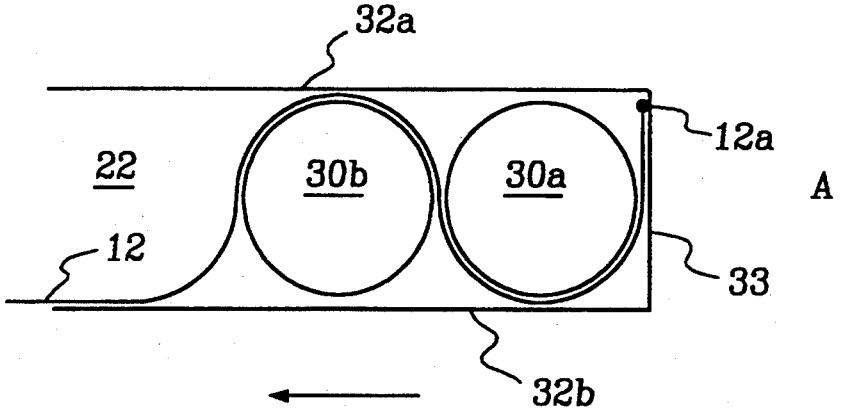
Figure 4G:
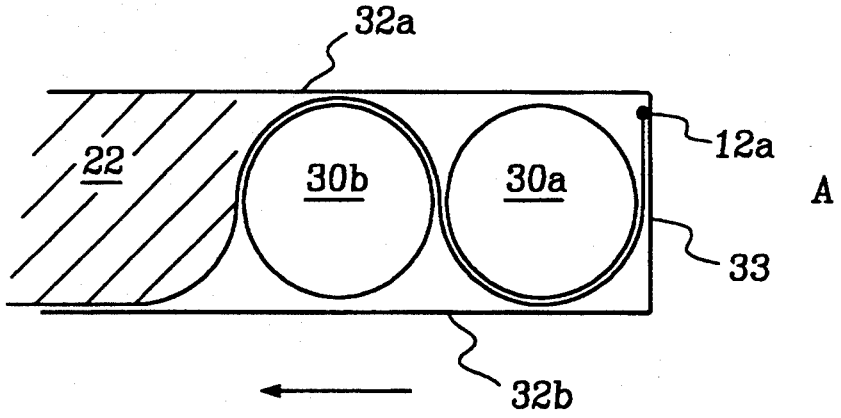

Turning now to FIG. 4A, the trench 22 begins at beginning point A, and excavation is performed in the direction indicated by the arrow in FIG. 4A away from rear wall 33. As shown in FIG. 4B, the liner 12 initially is placed in the trench along a second wall **32*b*, with a first end proximate the rear wall 33. Before a significant amount of liner 12 has been placed in the trench 22, the liner 12 is repositioned in the trench 22, so that the first end of 12*a* of the liner 12 is adjacent to the rear wall 33 and the first wall 32*a*, as best shown in FIG. 4C. The first end is then secured in that position. The first pipe 30*a* is then inserted into the trench 22 between the liner 12 and the first wall 32*a*. The pipe 30*a* is then forced toward the rear wall 33 while it is being inflated, thereby, forcing the liner 12 into a L-shape against the rear wall 33 and the first wall 32*b*. Next, as shown in FIG. 4E, the second pipe 30*b* is inserted into the trench 22 between the liner 12 and the second wall 32*b*. The second pipe 30*b* is then inflated while also being forced toward the first pipe 30*a*. Once inflated, the liner 12 now forms a substantially backward S-shape configuration as in the top view of the trench 22 shown in FIG. 4F. The trench can then be back filled between the liner 12 and the first wall as shown in FIG. 4G as excavation of the trench 22** continues.

Figure 4H:
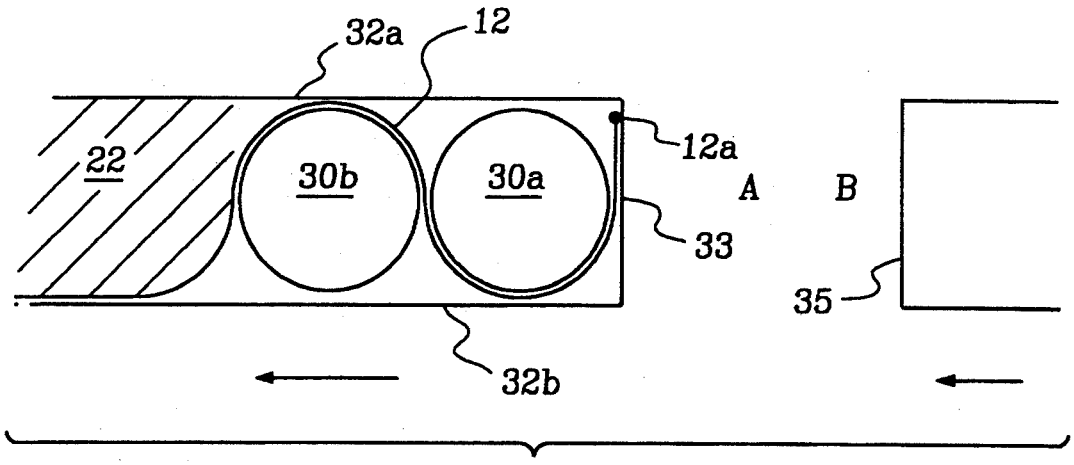

As shown, the trench 22 may continue to be excavated, and back filled with selected materials, such as commercially available clays, bentonite, or cement. The excavation and liner insertion process continues until a cutoff wall is constructed to isolate an area. Excavation of the trench 22 is continued in the direction indicated by the arrow in FIGS. 4A–4G, until the beginning point A is reached by the leading trench edge 35 at position B, forming a closed loop trench 22, shown in FIG. 4H, and as also shown in FIG. 2. Once the two ends A, B meet and the trench forms a substantially closed loop, the second end of the liner **12*b* can be overlapped with the first end of the liner 12*a*, forming an overlapping portion 38. Once the liner 12, with its overlapping portion 38, is securely in position, the trench 22** may be back filled with a pre-selected hardening material, described in further detail below.

Figure 5A:
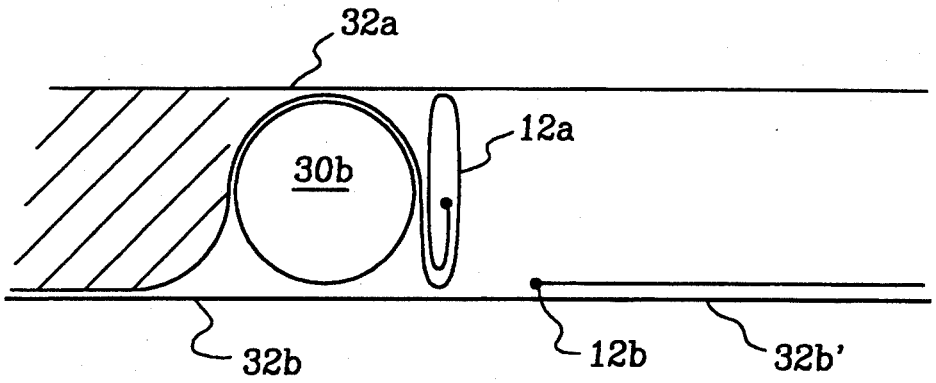
FIGS. 5A–5H are top plan views of the trench with a first and second sheets of liner material, and a first, second and third pipes.
Figure 5B:
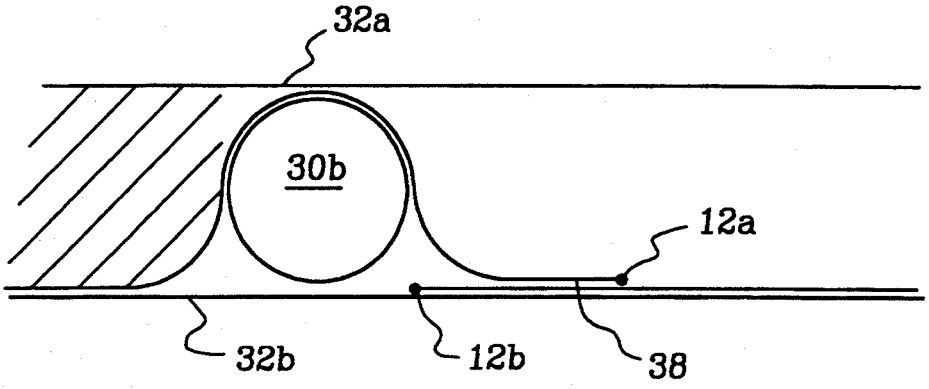

Turning now to FIG. 5A, prior to continued excavation and once the two initial pipes **30*a*, 30*b* are in position, the first pipe 30*a* may be removed and the liner material 12 may be moved away from the trench wall 32*b*. The trench 22 may then be further excavated until it reaches the beginning point A. The leading end 12*b* of the liner material 12 may then be placed adjacent to the trench wall 32*b*, traversing the space left by the first pipe 30*a* and at least partially extending along the wall 32*b* of the newly excavated portion of the trench 22. The first end 12*a* of liner material then may be placed over the second end 12*b* to form an overlapping portion 38 of liner ends 12*a*, 12*b*, as shown in FIG. 5B**.

The liner may be formed from the same sheet of material as the first liner 12, or may be formed from a separate sheet of material. In a preferred form of the invention, the overlapping portion 38 is formed from opposite ends **12*a*, 12*b* of the same sheet of liner 12**.

Figure 5C:
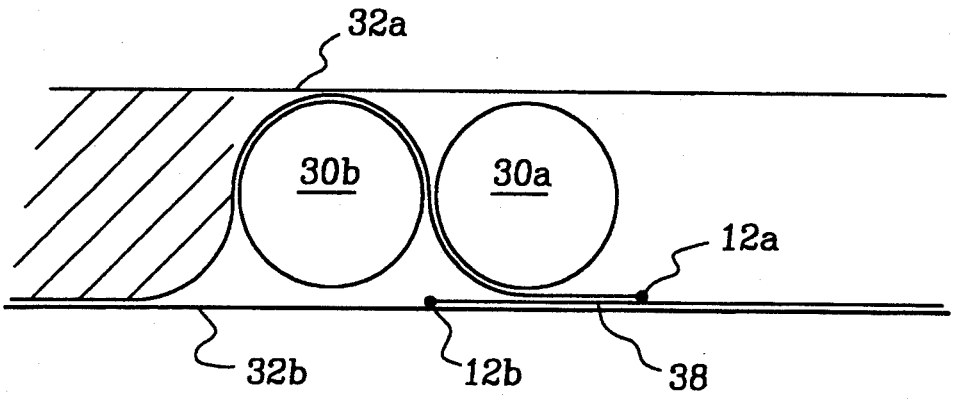
Figure 5D:
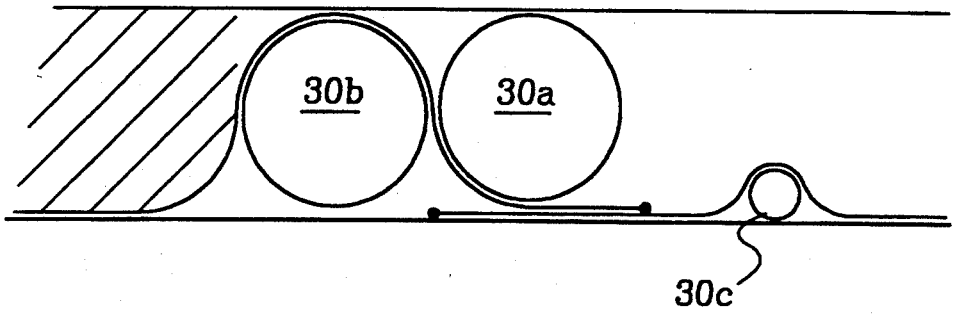
Figure 5E:
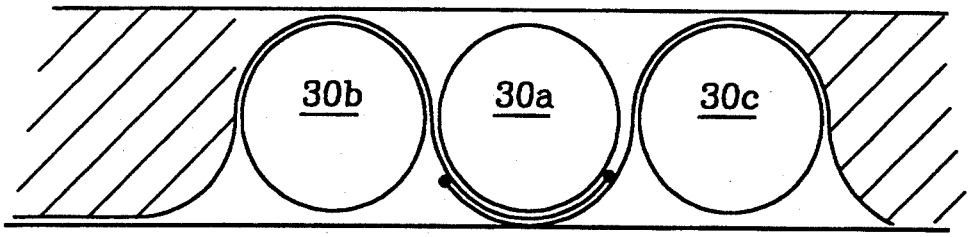

As shown in FIG. 5C, the first pipe **30*a* is re-installed against the overlapping portion 38 of the liner 12. This first pipe 30*a* may be the same or different from the pipe initially installed. A third pipe 30*c* then may be installed next to the first pipe 30*a*, to secure the liner 12 against the trench wall 32*a*, forming a serpentine configuration of the liner material 12 as shown in FIG. 5D. Once the third pipe 30*c* is in place, the trench 22 adjacent to the third pipe 30c may be back filled to secure further the liner 12 against the trench wall 32a** as shown in FIG. 5E. The same or different back fill material may be used for each of the back filling steps of the invention.

Figure 5F:
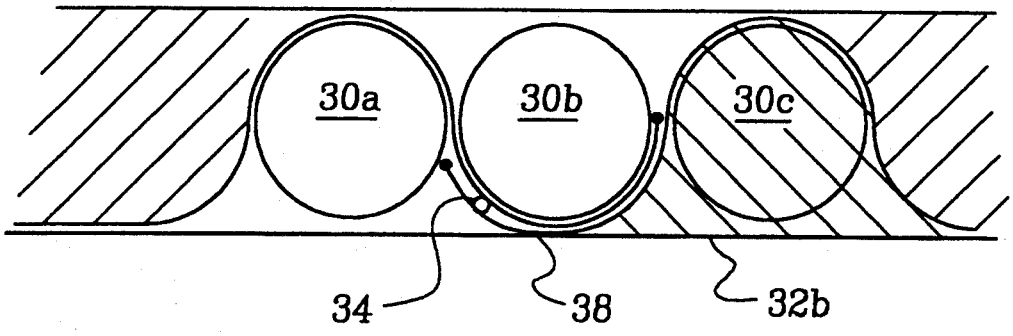

The third pipe 30c then may be removed, followed by back filling the space left by the third pipe 30c between the liner and the second wall 32b, as shown in FIG. 5F. This step secures the liner material 12 in its position across the trench 22 and against wall 32a, and completes the back fill in the trench 33. Pipes 30a and 30b may each be removed, followed by back filling after removal of each pipe 30a, 30b. The exact order of removing pipes 30a, 30b may depend upon the specific circumstances of the excavation. However, it is important that a back fill step follow the removal of each pipe 30a, 30b to ensure that the liner material 12 remains in its desired position.

Figure 5G:
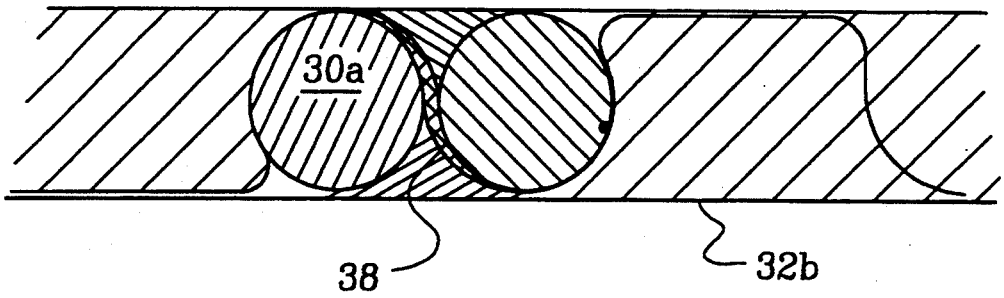
Figure 5H:
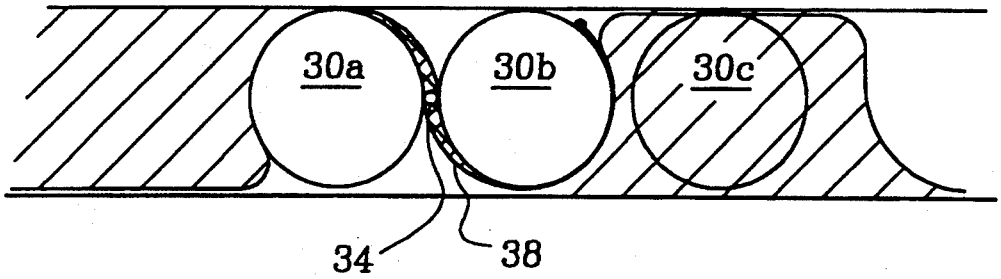

In a preferred form of the inventive method, and as shown in FIGS. 5F–5H, the method may include installation of an injection pipe 34 in the overlapping portion 38. The injection pipe 34 may be constructed of any rigid material of sufficient length and diameter to fit within the trench 22 and deliver solutions and adhesives. Preferably, the injection pipe 34 has a diameter 1/10th that of the trench 22. The pipe 34 may be installed by any means available to those skilled in the art, and may include simple insertion of the pipe 34 into the overlapping portion 38 without any mechanical assistance.

Preferably, a clearing solution, such as water, initially is forced through the injection pipe 34 and into the overlapping portion 38 to clear that portion 38 of debris between the liner 12. The injection pipe 34 then may be used to introduce an adhesive material between the liner 12. Although many commercially available adhesives may be used in practicing the present invention, preferred adhesive materials include cement, bentonite, or other commercially available chemical binding agents that would secure the liner 12 together. The injection pipe 34 may either be removed from the overlapping portion 38 after introduction of the adhesive material, or the trench 22 may be completely back filled leaving the injection tube in place.

Figure 6:
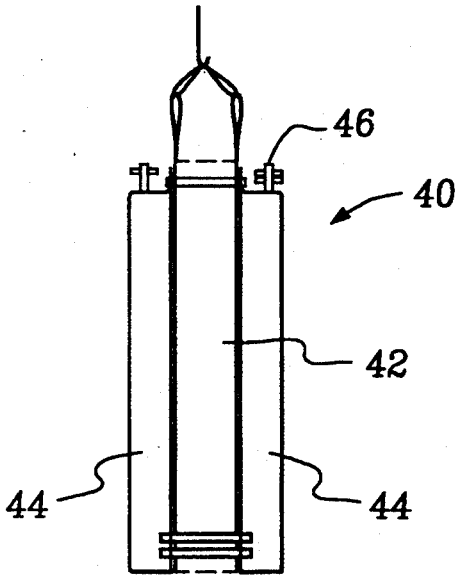
FIG. 6 is a cross-sectional side view of a preferred embodiment of an spacing pipe used in conjunction with the present inventive system and method.

In a preferred form of the invention, the rigid pipes 30a, 30b, 30c are spacing pipes. FIG. 6 shows a cross-sectional side view of an exemplary spacing pipe 40. As illustrated, a typical spacing pipe 40 includes a central pipe 42 of steel, PVC, or other rigid material. Surrounding the central pipe 42 is a flexible housing 44, preferably of a rubber or other elastic form material that forms an expandable membrane. Attached to the housing element 44 is a nozzle 46 for introducing air or water into the housing element 44. The injection pipe 34 may be constructed of any rigid material of sufficient length and width to fit within the trench in a secure manner. Preferably, the pipe 34 has a diameter slightly less than the diameter of the trench 22, such that it presses against the interior walls of the trench.

In practicing the present inventive method using a spacing pipe 40, the housing 44 initially is in a deflated state during installation of the pipe 40 into the trench 22. Once in position, air or water may be introduced into the housing 44 via the nozzle 46 to inflate the housing 44 and expand the circumference of the pipe 40. In this manner, the pipe 40 is secured in the trench 22 against both trench walls 32a, 32b. Removal of the pipe 40 is accomplished by opening the nozzle 46 to expel the air or water out of the housing 44 to reduce the circumference of the pipe 40.

Figure 7A:
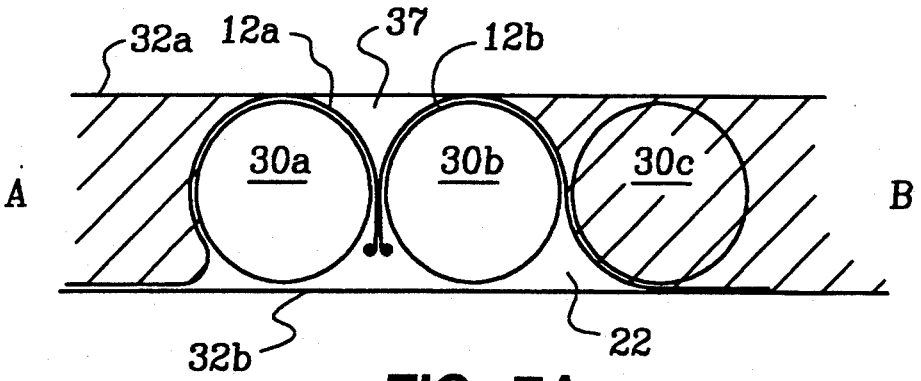
FIGS. 7A–7C are a top plan views of a second embodiment of the invention, showing a trench, two pipes, a joint pipe and two sheets of liner material.
Figure 7B:
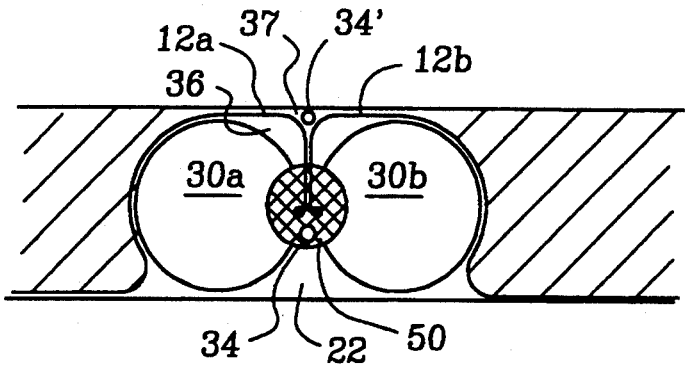
Figure 7C:
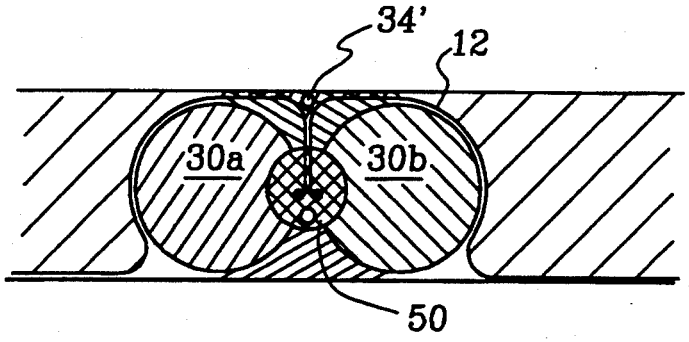

In an alternative embodiment, shown in FIGS. 7A–7C, the liner material 12 is positioned around the first pipe 30a in a substantially inverted U-shaped configuration. The steps described above with respect to FIGS. 4A–4G and 5A–5H apply generally in the alternative embodiment of FIGS. 7A–7C. However, instead of the liner material 12 overlapping along a trench wall, the liner material 12 of the alternative embodiment of FIGS. 7A–7C is positioned around each of the pipes 30a, 30b such that one end of each liner layer 12a, 12b overlaps between the two pipes 30a, 30b. Thus, the overlapping portion 38 may be held securely in place in the trench 22 between the two pipes 30a, 30b.

In practicing the illustrated embodiment of FIGS. 7A–7C, the liner end portion 12a is positioned in the excavated trench 22 and pipe 30a is positioned against the liner 12a to secure the liner 12a against trench wall 32a. This is achieved in a manner substantially similar to that described above. Following further excavation of the trench 22, a third pipe 30c may be positioned proximate the first pipe 30a, with liner layer 12b secured between pipes 30c and the second wall. The other liner end 12b is then positioned against trench wall 32a and overlapping liner end 12a adjacent to pipe 30a. A second pipe 30b may be positioned against the liner layer 12b, to secure liner layers 12a, 12b between pipes 30a, 30b and 30c. Once the liner layers 12a, 12b are secured, the third pipe 30c may be removed and the space left by that pipe 30c may be back filled in a manner substantially similar to that described in further detail above.

As shown in FIG. 7B, after pipe 30c is withdrawn, and the back fill is in place, the next two pipes 30a, 30b may be withdrawn and a joint pipe 50 may be installed to retain the overlapping ends of liner layers 12a, 12b together. Once the joint pipe 50 is secured into position, the remainder of the trench 22 may be back filled with standard back fill material, as shown in FIG. 7C.

Figure 8:
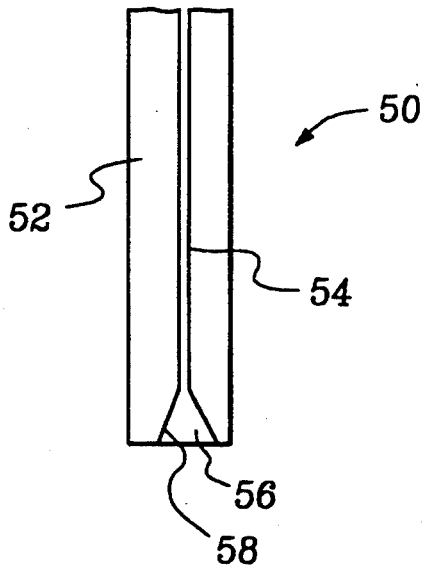
FIG. 8 is a cross-sectional side view of a preferred embodiment of the joint pipe used in conjunction with the inventive method.

A side view of an exemplary joint pipe 50 is shown in FIG. 8. Housing 52 may be manufactured from steel, PVC, or another substantially rigid material. The pipe 50 preferably has a cross-sectional "C" shape, including a slit 54 running along the longitudinal axis of the housing 52. Typically, the slit 54 includes a fluted opening 56 at one end of the housing 52 to accept materials, such as liner material 12, to be joined.

In practicing the present invention using the exemplary joint pipe 50, once the first pipe 30a and second pipe 30b are removed from the trench, the overlapping ends of the liner layers 12a, 12b are inserted into pipe ridge 54 via the fluted opening 56. In a preferred form of the invention, an injection pipe 34, similar to that described above, is included in the joint pipe 50. Air or water may be first forced through the injection pipe 34 into the joint pipe 50 to clear out any debris that may have been introduced during installation. Next, an adhesive material may be introduced into the joint pipe 50 via the injection pipe 34 to secure the ends of liner material 12 within the joint pipe 50. Preferably, both the joint pipe 50 and the injection pipe 34 are left in place when the remainder of the trench 22 is back filled.

In another embodiment, as shown in FIG. 7B, a second injection pipe 34' may be positioned in the space 37 above the overlapping portion. The space 37 may then be cleared using the injection pipe 34'. Once the space is cleared, it may be filled with grouting or other filler material.

Figure 9A:
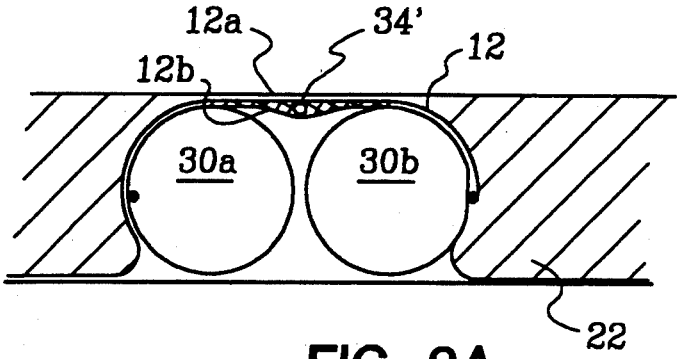
FIGS. 9A–9B are top plan views of a third embodiment of the inventive method showing a trench having two installed pipes, overlapping sheets of liner material.
Figure 9B:
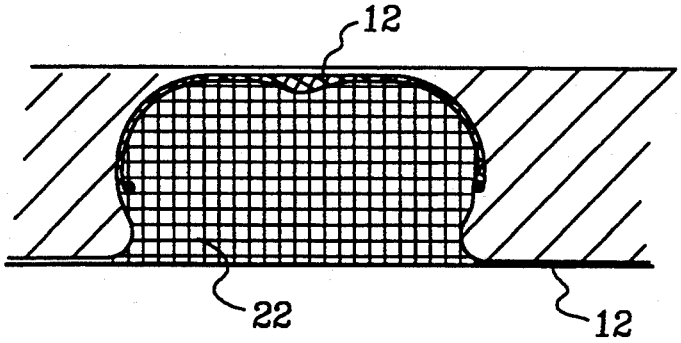

In yet another embodiment, shown in FIGS. 9A–9B, the trench 22 is excavated, and the liner material 12 is overlapped in a manner similar to that described above. However, in the present embodiment, the liner material 12 is positioned between one trench wall 32*a* and the two pipes 30*a*, 30*b* with the liner material 12 forming a substantially U-shape about the two pipes 30*a*, 30*b*. An injection pipe 34 may be positioned between the liner layers 12*a*, 12*b* and introduce adhesive between the layers 12*a*, 12*b*. The trench 22 may then be back filled using the method described above, resulting in placement of overlapping liner layers 12*a*, 12*b* in a substantially U-shaped configuration, as shown in FIG. 9B.

Having described the present invention with reference to specific embodiments, the above description is intended to illustrate the operation of the preferred embodiments and is not meant to limit the scope of the invention. The scope of the invention is to be limited only by the following claims. From the above discussion, many variations will be apparent to one skilled in the art that would yet be encompassed by the true spirit and scope of the present invention.

What is claimed is:

1. A method of joining liners within a trench, comprising the steps of:

excavating a trench of predetermined width having a first wall and a second wall from a beginning point;

inserting a liner having a first end and a second end in the trench;

securing the first end of the liner against the first and second walls and extending the liner across the trench proximate the beginning point such that the liner forms a substantially S-shape in cross-section at the first end;

further excavating the trench about an area until the beginning point is reached;

overlapping the first end of the liner with the second end of the liner to form an overlapping portion such that the overlapping portion forms a substantially U-shape in cross-section; and back filling the trench with a pre-selected hardening material to secure the overlapping portion of the liner against the first and second walls and across the trench.

2. The method of claim 1, wherein the securing step comprises the step of positioning a first rigid pipe, the first pipe having an outer diameter about the same dimension as the width of the trench, adjacent to the first end of the liner material to secure the first end of the liner material against the second wall.

3. The method of claim 2, wherein the first pipe comprises a spacing pipe, the method further comprising the steps of:

installing the first pipe in a deflated form; and then expanding the first pipe once the first pipe is in position in the trench.

4. The method of claim 2, further comprising the step of positioning a second rigid pipe, having an outer diameter about the same dimension as the width of the trench, adjacent to the first end of the liner material such that the liner material is positioned between the first pipe and the second pipe.

5. The method of claim 4, wherein the second pipe comprises a spacing pipe, the method further comprising the steps of:

installing the second pipe in a deflated form; and then expanding the second pipe once the second pipe is in position in the trench.

6. The method of claim 4, further comprising the step of:

after the overlapping step, positioning a third rigid pipe adjacent to the second end of the liner between the second wall and the liner, to secure the liner material against the first wall of the trench, thus forming a substantially M-shaped overlapped liner in cross-section.

7. The method of claim 6, wherein the third pipe comprises a spacing pipe, the method further comprising the steps of:

installing the third pipe in a deflated form; and then expanding the third pipe once the third pipe is in position in the trench.

8. The method of claim 6, wherein the back filling step further comprises the steps of:

back filling the trench containing the first, second and third pipes;

removing the third pipe; and then back filling the trench containing the first pipe and the second pipe.

9. The method of claim 8, wherein the back filling step further comprises the steps of:

back filling the trench containing the first pipe and the second pipe;

removing the first pipe and the second pipe from the trench; and back filling the trench to completion.

10. The method of claim 1, further comprising the step of back filling the trench as it is excavated from the beginning point.

11. The method of claim 1, wherein the inserting step involves inserting a first liner, and wherein the overlapping step comprises overlapping a first end of a second liner with the second end of the first liner.

12. The method of claim 1, further comprising the step of installing an injection tube within the overlapping portion.

13. The method of claim 12, further comprising the step of injecting an adhesive material within the overlapping portion through the injection tube.

14. A method of joining liners within a trench comprising the steps of:

excavating a trench of predetermined diameter having a first wall and a second wall from a beginning point;

inserting a liner having a first end and a second end in the trench;

securing the first end of the liner against the second wall and extending the liner across the trench proximate the beginning point such that the liner forms a substantially S-shape in cross-section at the first end;

further excavating the trench about an area until the beginning point is reached;

overlapping the first end of the liner with the second end of the liner to form an overlapping portion such that the overlapping portion forms a substantially inverted W-shape in cross-section; and back filling the trench with a pre-selected hardening material to secure the overlapping portion of the liner against the first and second walls and across the trench.

15. The method of claim 14, wherein the securing step comprises the step of positioning a first rigid pipe, the pipe having an outer diameter about the same dimension as the diameter of the trench, adjacent to the first end of the liner material to secure the first end of the liner material against the second wall.

16. The method of claim 15, further comprising the step of positioning a second rigid pipe, having an outer diameter about the same dimension as the diameter of the trench, adjacent to the first end of the liner material such that the liner material is positioned between the first pipe and the second pipe.

17. The method of claim 14, further comprising, after the overlapping step, installing a joint pipe to secure the first end and the second end of the liner.

18. The method of claim 17, further comprising the step of installing an injection tube into the joint pipe.

19. The method of claim 18, further comprising the step of injecting an adhesive material within the joint pipe through the injection tube.

* * * * *